United States Patent [19]

Grunbaum

[11] 4,169,788

[45] Oct. 2, 1979

[54] SCREENING MACHINE

[75] Inventor: Peter Grunbaum, Graz, Austria

[73] Assignee: Binder & Co. Aktiengesellschaft, Gleisdorf, Austria

[21] Appl. No.: 882,822

[22] Filed: Mar. 2, 1978

[30] Foreign Application Priority Data

Mar. 23, 1977 [AT] Austria ..... 2034/77

[51] Int. Cl.[2] ..... B07B 1/54

[52] U.S. Cl. ..... 209/328; 209/382; 209/365 R

[58] Field of Search ..... 209/325, 322, 379, 381, 209/382, 415, 327–330, 365 R; 55/300; 210/384, 388, DIG. 18; 248/15; 267/36 R, 47, 19 R, 158, 160

[56] References Cited

U.S. PATENT DOCUMENTS

| | | | |
|---|---|---|---|
| 1,904,032 | 4/1933 | Roberts | 209/382 |
| 3,483,974 | 12/1969 | Pearsall | 209/382 |
| 3,796,311 | 3/1974 | Krause | 209/382 |

FOREIGN PATENT DOCUMENTS

| | | | |
|---|---|---|---|
| 605300 | 1/1932 | Fed. Rep. of Germany | 209/381 |
| 2450138 | 4/1975 | Fed. Rep. of Germany | 209/382 |

*Primary Examiner*—Frank W. Lutter
*Assistant Examiner*—Jon Hokanson
*Attorney, Agent, or Firm*—Sprung, Felfe, Horn, Lynch & Kramer

[57] ABSTRACT

A screening machine (FIG. 3) having a vibrator constructed so that the striking elements 7 move substantially only vertically. The vibrator comprises springs having crossing elements 2,3 mounted on the frame and connecting member 4. The connecting member 4 can be moved to rotate the striking elements about the crossing point D of the crossing elements, which is disposed substantially in the plane of the spring.

9 Claims, 7 Drawing Figures

SCREENING MACHINE

BACKGROUND

The invention relates to a screening machine having striking elements which can act on the lower face of the screen and which by means of a tube connected to them, extending over the length of the screen and connected to a drive, cause the screen to perform a vibrating movement.

With known mountings both end parts of the striking elements are mounted in the screen frame with the aid of rubber bushes. Another form of construction is described in German Gebrauchsmuster No. 7,206,763 and achieves a certain improvement by utilizing a self-aligning bearing. Neither of these known arrangements is satisfactory. In order to achieve a screening effect very fine screen fabrics must be vibrated at high frequencies. Since a high driving power is required to vibrate the entire screen box at high frequencies, the expedient has been adopted of using a stationary screen box and vibrating the screen fabric directly by means of striking elements. Striking elements of this kind are described for example in Austrian Patent Specification No. 322,477. Another form of construction of the striking elements is shown in Austrian Patent Specification No. 301,471. These two forms of construction have the common disadvantage that the striking elements perform a rotary movement and thus chafe the screen at the point of contact, particularly in the case of small-mesh screens.

Another disadvantage of known mountings is the rubber bush at the center of rotation of the tube vibrating about it, since this bush becomes unusable after a short time as the result of wear.

THE INVENTION

The problem underlying the invention is that of so constructing a screening machine of the kind first defined above that the screen is not destroyed at the points where the striking elements act, while on the other hand all play is eliminated throughout the operating time of the machine.

According to the invention this problem is solved in that the tube disposed under the screen is connected to the screening machine by means of universal joint springs, that the crossing point of the latter lie approximately in the plane of the screen, that the tube is movable only in the horizontal diection transversely to its length, and that the crossing points of the universal joint springs are centers of rotation for the tube and for the striking elements, which consequently are movable only vertically. Since the center of rotation of the moving parts is transferred to the plane of the screen, there is no longer a horizontal movement of the striking elements and the points of contact with the screen and protected since no chafing movement occurs.

Thus, the invention provides an improvement in a screening machine comprising a frame, a screen mounted on the frame, and a screen vibrator mounted on the frame having a striking element for vibrating the screen and drive means for moving the striking element to provide the vibration. According to the invention, the drive means includes a universal joint spring comprising crossing elements. An end of each crossing element is connected to the frame, and the spring includes a connecting member joining the other end of each crossing element. The crossing elements cross each other substantially in the plane of the screen. Mounting means are provided for securing the striking element to the connecting member. The connecting member can be moved to rotate the striking element about the crossing point of the crossing elements as the center of rotation for the striking element, whereby the striking element is substantially moved only vertically. As more particularly contemplated, the drive means comprises a second universal joint spring, with the connecting members of the springs being disposed on the same side of the screen and the mounting means for the striking element being secured to the connecting member of each of the springs and comprising a bar or tube joining the connecting members. The bar or tube is moveable only in the direction of the plane of the screen and transversely to its length to move the connecting members to provide rotation of the striking element as aforesaid.

The invention also provides that the striking elements in the form of raised bars can be connected to the tube by means of arms which are disposed transversely to the tube and through which the tube passes, and that one of the crossing members of each spring passes through the other crossing member with clearance, a narrowed middle portion of one member engaging in a longitudinal slot in the other member. This results in a sturdy construction of the moving parts and movement of the springs without play and with little friction. According to the invention it is also possible for the universal joint springs to be fastened to the upper side of the machine by means of blocks, for example with the aid of screws, and for the springs to act by their bottom ends on blocks which carry the tube together with the arms and the striking elements. In addition, the invention provides for the universal joint springs to be fastened on inclined surfaces of the blocks with the aid of plates, for example by means of screws. Forces of several hundred kp can be transmitted by means of this universal joint. Universal joints known in precision mechanics on the other hand at most transmit forces of the order of several p.

The prior art is compared with the invention in the drawing wherein.

Figure 4A:
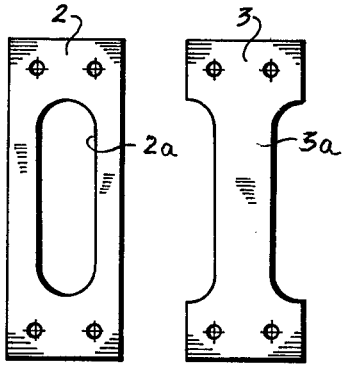
Figure 4B:
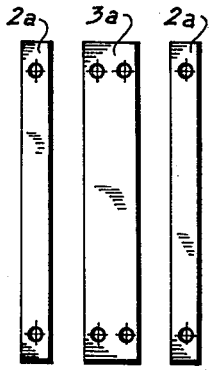

FIGS. 4*a* and 4*b* show two alternatives for the crossed springs; and

Figure 5:
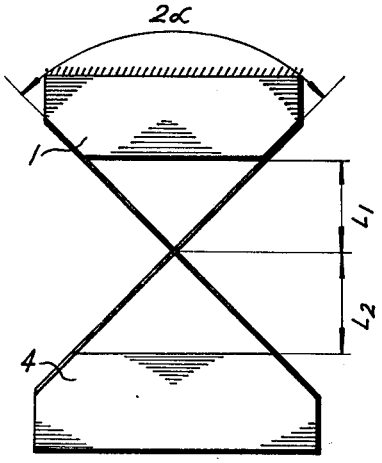
Figure 6:
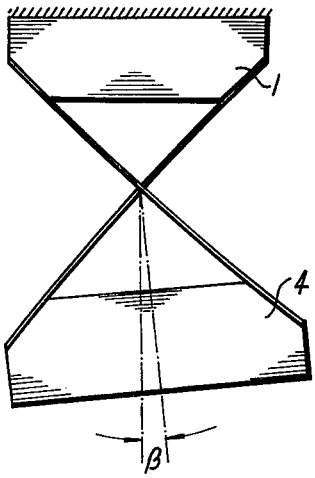

FIGS. 5 and 6 show details of angles and length dimensions of the universal joints.

Figure 1:
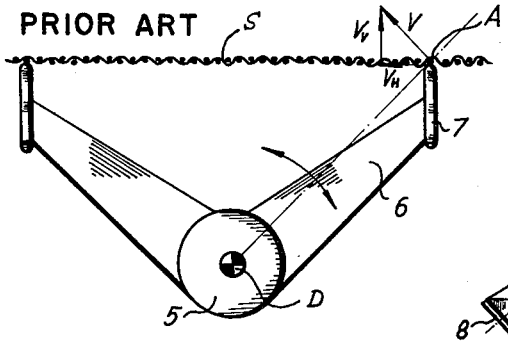
FIG 1 PRIOR ART
FIG. 1 shows the known mounting of the striking elements of a screening machine in an end elevation.

In the known mounting shown in FIG. 1 the striking elements 7 are in contact at the point A with the screen fabric S and are connected by levers 6 to the tube 5, which can perform reciprocating rotary movements about the point D as indicated by the arrow. The path of movement of the point A constitutes a perpendicular V to the connecting line AD and can be split up into a movement $V_H$ parallel to the screen fabric and a movement $V_V$ normal to the screen fabric. For the purpose of generating vibrations of the screen fabric only the normal movement $V_v$ is required, whereas the parallel movement $V_H$ results in the chafing of the screen fabric S by the striking element 7. Measurements of relative movements between 7 and S showed that this parallel movement $V_H$ very rapidly destroys the screen fabric, particularly in the case of small-mesh screens.

The tube 5 can of course always be installed closer to the screen fabric S, but a constructional limit is imposed by the radius of the tube, so that there will always be a distance between D and S which will give rise to the parallel movement $V_H$.

Another disadvantage of known mountings for the tube 5 at the point D with the aid of rubber bushes is the fact that the latter cannot have sufficient radial stiffness to prevent an additional chafing movement to $V_H$. Information from the manufacturers shows that after an operating time of about 6 months known self-aligning bearing will have worn to such an extent that the play may already be of the order of magnitude of the required movement amplitude of the point A in the direction $V_v$, so that once again increased chafing occurs between 7 and S.

In contrast thereto, according to the invention universal joint springs or crossed spring joints are used for mounting the striking elements in a screening machine. In precision mechanics these crossed spring joints are used for the practically force-free and play-free mounting of measuring instrument parts or pendulums having small swinging angles. The kinematics of the joint and the deflection of the center of rotation are known from calculations and microscope observations.

Figure 2:
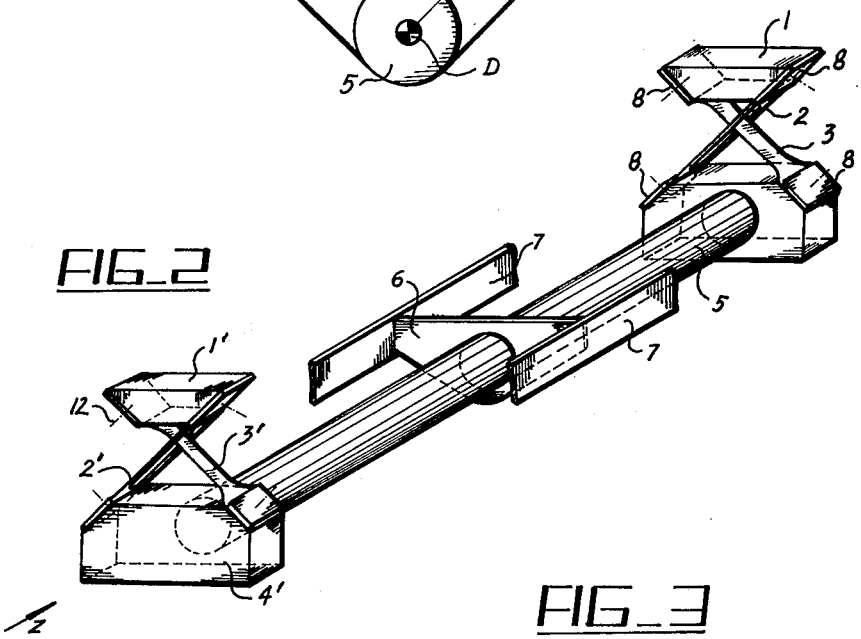
FIG. 2 shows in perspective the mounting of the striking elements according to the invention.

FIG. 2 shows how the actual vibrator, comprising the striking elements 7 (shown partly cut away), the arms 6 (only one of which is shown), the bar in the form of tube 5, and the bottom blocks 4 and 4', is connected by means of the crossing elements 3, 2 and 3', 2' respectively to blocks 1 and 1' which are fastened to the screen box. The plates 8 and the screws 12 (schematically indicated) permit detachable connection between the blocks 4,4', 1,1' and the crossed springs 2, 2', 3, 3'. The blocks 4,4', 1, 1' consist of steel.

Figure 3:
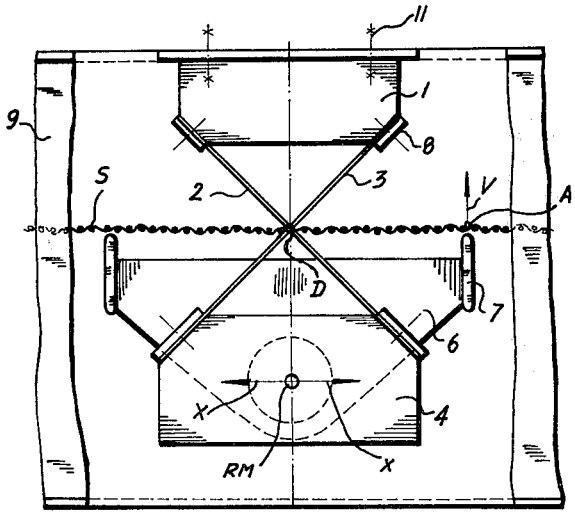
FIG. 3 is an end view of the mounting of FIG. 2.

In FIG. 3 it can in addition be seen how the arrangement shown in FIG. 2 is connected to the screen box 9 by means of the screws 11, so that the connecting line between the center of rotation D and the upper edge A of the striking elements 7 coincides exactly with the screen fabric S also shown in the drawing. Thus the invention makes it possible for the first time to construct a rotary joint in such a manner that the direction of movement V of the point A (see also FIG. 1) is exactly perpendicular to the screen fabric S. FIG. 3 also shows that the tube center RM which in the known arrangement as shown in FIG. 1 coincides with the center of rotation D, now lies some distance below D and that nevertheless the direction of movement V at A is perpendicular to S. If the block 4 is now conceived as performing reciprocating movements X through the action of a drive, which will not be described further, these movements being mainly of the order of magnitude of a few millimeters, the point A will perform an upward and downward movement V, which is imparted to the screen S, since all points of the rotatable system consisting of the parts 4,5,6, and 7 turn exactly about D.

In FIG. 4*a* the springs 2 and 3 form a pair as shown in FIG. 3, the web 3*a* of the spring 3 fitting with clearance in a slot 2*a* in the spring 2 in order to enable assembly inaccuracy to be compensated, so that during the small relative movements no chafing will occur between 2 and 3.

In FIGS. 4*a*, 2*a* and 3*a* may consist of bars having a round, square, or rectangular cross-section, while however the moment of resistance of each spring 2*a* which is on the outside is, as far as possible, half as great as the moment of resistance of the spring 3*a* lying on the inside. This arrangement is adopted because the joint is then symmetrical.

With reference to FIG. 5 some of the main dimensions of the joint will be described. The opening or crossing angle $2\alpha$ can in theory be between 0° and 180°, while practical utilisability extends only from 30° to 150°, and for reasons of manufacture a preferred case will comprise 90°. The ratio of the length $L_1/L_2$ will vary for practical purposes between 0.15 and 1. It can be shown mathematically that with a ratio $L_1/L_2=0.25$ an optimum is achieved in respect of the displacement of the center of rotation at the crossing point of the springs, this displacement in any case being extremely slight.

FIG. 6 shows diagrammatically how the two crossed springs bend to the extent of the angle $\beta$ when the block 4 deflects and block 1 is held fast. The angle $\beta$ in practical application is about 2° or less.

The universal joint springs are disposed outside of opposite edges of the screen.

What is claimed is:

1. In a screening machine comprising a frame, a screen mounted on the frame, and a screen vibrator mounted on the frame having a striking element for vibrating the screen and drive means for moving the striking element to provide the vibration, the improvement which comprises said drive means including two universal joint springs, each spring comprising crossing elements, an end of each crossing element being mounted on the frame, and a connecting member joining the other end of each crossing element, the connecting members of the springs being disposed on the same side of the screen, the crossing elements of each spring crossing each other substantially in the plane of the screen, and mounting means securing the striking element to the connecting members and comprising a bar joining the connecting members, the bar being moveable in the direction of the plane of the screen and transversely to its length to move the connecting members to rotate the striking element about the crossing points of the crossing elements as the center of rotation for the striking element, whereby the striking element is substantially moved only vertically.

2. Screening machine of claim 1 wherein the striking element is connected to the bar by means of an arm disposed transversely to the tube.

3. Screening machine of claim 1, or 2, wherein, for each spring, one of the crossing elements passes through the other crossing element with clearance, a narrowed middle portion of one crossing member being disposed in a longitudinal slot in the other.

4. Screening machine of claim 1, or 2, wherein, for each spring, one crossing element comprises two narrow spring members and the other crossing element comprises a wider spring member disposed with clearance between the narrow spring members.

5. Screening machine of claim 1, wherein, for each spring, the crossing elements are connected to the frame by a block, and the connecting members are blocks.

6. Screening machine of claim 5, the ends of the crossing elements being secured to inclined surfaces of the blocks.

7. Screening machine of claim 1, wherein, the crossing angle $2\alpha$ of the crossing elements is between 30° and 150°.

8. Screening machine of claim 1, wherein, the crossing angle $2\alpha$ of the crossing elements is about 90°.

9. Screening machine of claim 1, wherein the connecting members, in said movement to rotate the striking element, can be rotated an angle $\beta$ about the crossing point of the crossing elements, the angle $\beta$ being about 2°.

* * * * *